United States Patent [19]

Hake

[11] 4,058,915

[45] Nov. 22, 1977

[54] BACKHOE-MOUNTED SHEAR

[75] Inventor: Leon M. Hake, Perry, Okla.

[73] Assignee: Wittwer Construction Company, Oskaloosa, Kans.

[21] Appl. No.: 693,743

[22] Filed: June 8, 1976

[51] Int. Cl.[2] ..... B26D 7/00; E02F 3/76

[52] U.S. Cl. ..... 37/117.5; 37/DIG. 3; 83/749; 83/658; 83/928; 214/DIG. 5

[58] Field of Search ..... 37/117.5, DIG. 3, DIG. 12, 37/103; 83/928, 902, 749, 582, 588, 658, 627; 214/138 R, 145 R, DIG. 5

[56] References Cited

U.S. PATENT DOCUMENTS

| | | | |
|---|---|---|---|
| 1,438,888 | 12/1922 | Barton | 83/588 X |
| 1,777,032 | 9/1930 | Bull | 83/902 X |
| 2,044,624 | 6/1936 | Morgan | 214/138 R |
| 2,144,540 | 1/1939 | Lindgren | 83/588 X |
| 2,281,877 | 5/1942 | Green | 83/658 |
| 2,332,561 | 10/1943 | Drott | 37/DIG. 3 X |
| 3,195,387 | 7/1965 | Telfer | 83/588 X |
| 3,264,924 | 8/1966 | Yaron | 83/902 X |
| 3,275,172 | 9/1966 | Smith | 214/138 R |
| 3,743,358 | 7/1973 | Guest | 37/117.5 X |
| 3,968,714 | 7/1976 | Kuchyt | 83/582 |

*Primary Examiner*—E. H. Eickholt
*Attorney, Agent, or Firm*—Schuyler, Birch, Swindler, McKie & Beckett

[57] ABSTRACT

The device comprises a shear adapted to be mounted to the boom of a backhoe or like machinery with relatively movable members and be actuated by a powered, movable member of the backhoe. The shear comprises a generally U-shaped support member adapted to be disposed about the top of the backhoe boom. The shear also includes a pivotally mounted cutter head adapted to engage an anvil section attached to the support member to shear an item such as a metal member inserted therebetween. A cutter head is actuated by the backhoe movable member and is pivotally returned to a raised position after a shearing operation by a biasing means connected to the cutter head. The invention also includes a locking means to maintain the cutter head in a closed position when a shearing operation is not desired; a stripping member disposed adjacent the anvil section to assist in restraining items to be sheared during a shearing operation; and a guide member for preventing excessive deflection of the cutter head during a shearing operation.

8 Claims, 5 Drawing Figures

BACKHOE-MOUNTED SHEAR

BACKGROUND OF THE INVENTION

1. Field of the Invention

The invention relates to shears and, more particularly, to a shear adapted to be mounted to the boom of a conventional backhoe or like machinery having relatively movable members and be actuated by a powered, movable member of the backhoe.

2. Description of the Prior Art

On many types of construction projects it is often desired to shear materials. For example, in a construction project involving concrete fabrication, reinforcing steel commonly is embedded in the concrete. It is necessary, however, that the reinforcing steel be cut to a proper length prior to placing the reinforcing steel and having the concrete poured about the steel. Conventional techniques for cutting the reinforcing steel to proper lengths generally involve one of two techniques:

a. A metal shear is placed at the job site and reinforcing steel to be sheared is carried to the metal shear and thence to wherever required in the vicinity.

b. Measurements of the required lengths of reinforcing steel are made at the job site and the steel is sheared elsewhere prior to being shipped to the job site in trimmed condition.

Both of the above-mentioned techniques involve a considerable expenditure of money and materials. In both cases, a separate machine must be employed, namely, the metal shear. Such devices usually are quite expensive as well as difficult to maneuver from job site to job site. If the second technique of shearing is employed, accurate measurements are required and oftentimes mistakes may be made which result in a considerable waste of material.

Accordingly, it is an object of the invention to provide an improved shear which is inexpensive.

It is another object of the invention to provide a new and improved shear adapted to be maintained at the job site.

It is a still further object of the invention to provide a new and improved shear which may be affixed to existing machinery having relatively movable members and operated thereby, thus obviating many of the difficulties commonly associated with conventional shears.

SUMMARY OF THE INVENTION

In carrying out the invention, in one form thereof, a shear is adapted to be mounted to the boom of a backhoe or like machinery having relatively movable members and actuated by a powered, movable member of the backhoe. The shear comprises a generally U-shaped support member adapted to be disposed about the top of the backhoe boom. The shear also includes a pivotally mounted cutter head adapted to engage an anvil section attached to the support member to shear an item inserted therebetween. The cutter head is actuated by the backhoe such as by a portion of backhoe dipstick and is pivotally returned to a raised position after a shearing operation by a biasing means connected to the cutter head. The invention also includes a locking means to maintain the cutter head in a closed position when a shearing operation is not desired; a stripping member disposed adjacent the anvil section to assist in restraining items to be sheared during a shearing operation; and a guide member for preventing excessive deflection of the cutter head during a shearing operation.

DESCRIPTION OF THE PREFERRED EMBODIMENT

Figure 1:
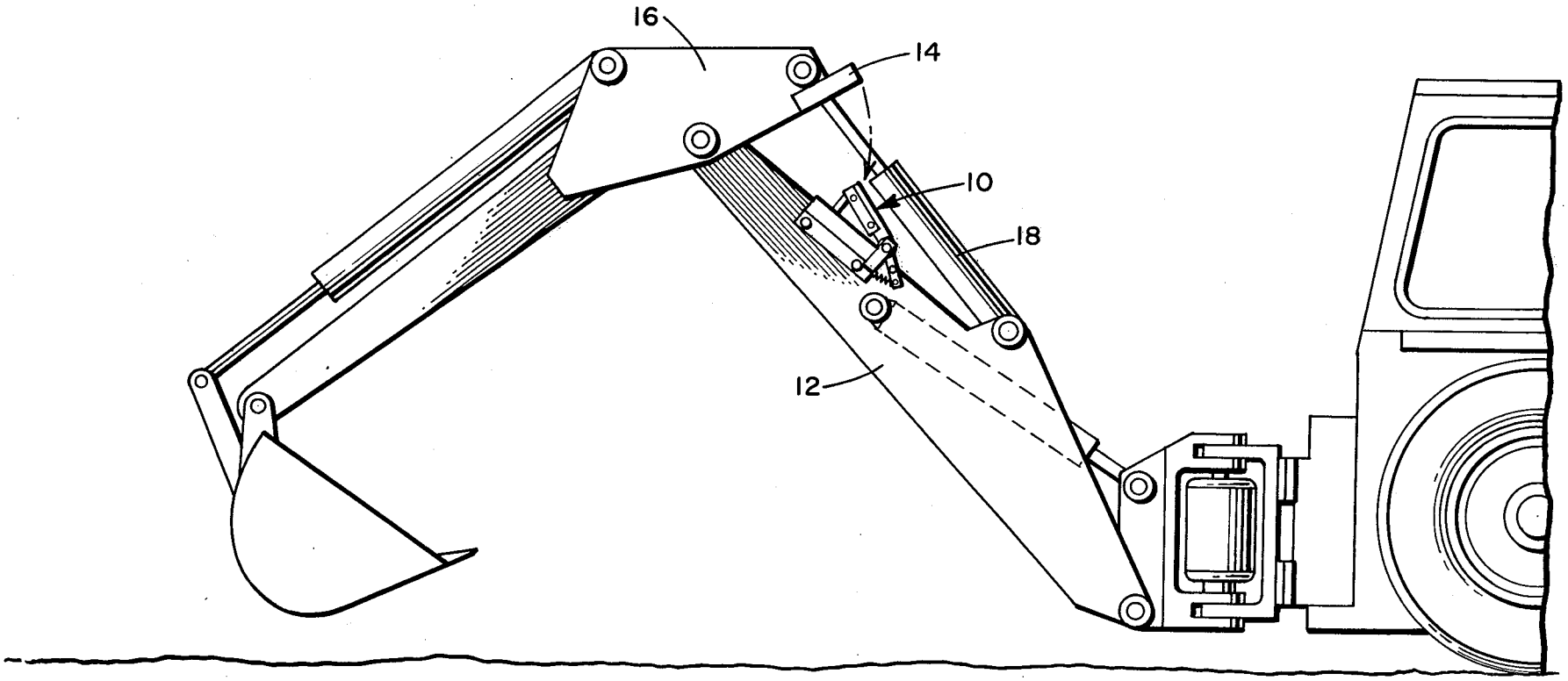
FIG. 1 is a side elevational view of one form of a shear according to the invention mounted to the boom of a backhoe.

FIG. 1 shows a shear 10. Shear 10 is illustrated as mounted to a backhoe boom 12 and to be actuated by an extension 14 on backhoe dipstick 16 upon the retraction of hydraulic cylinder 18. It is intended that shear 10 will be constructed of any well known, conventional materials sufficient to shear items such as reinforcing steel commonly employed in construction projects. Furthermore, the shear employed as part of the present invention may be fitted to virtually any existing backhoe as well as to other types of machinery such as bulldozers, highlifts, front end loaders, etc. where the machinery has relatively movable members which are power actuated, with respect to each other. In this type machinery, the shear can be mounted to a first member of the machinery and actuated by a powered member of the machinery which is movable relative to the first member.

Figure 4:
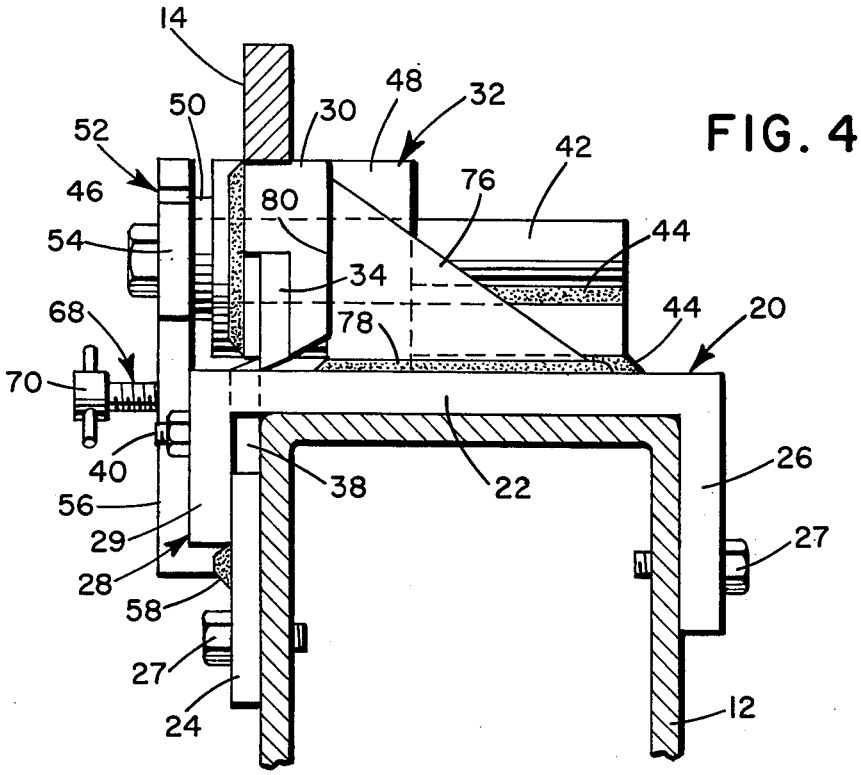
FIG. 4 is a sectional view taken along line 4—4 of FIG. 2.
Figure 5:
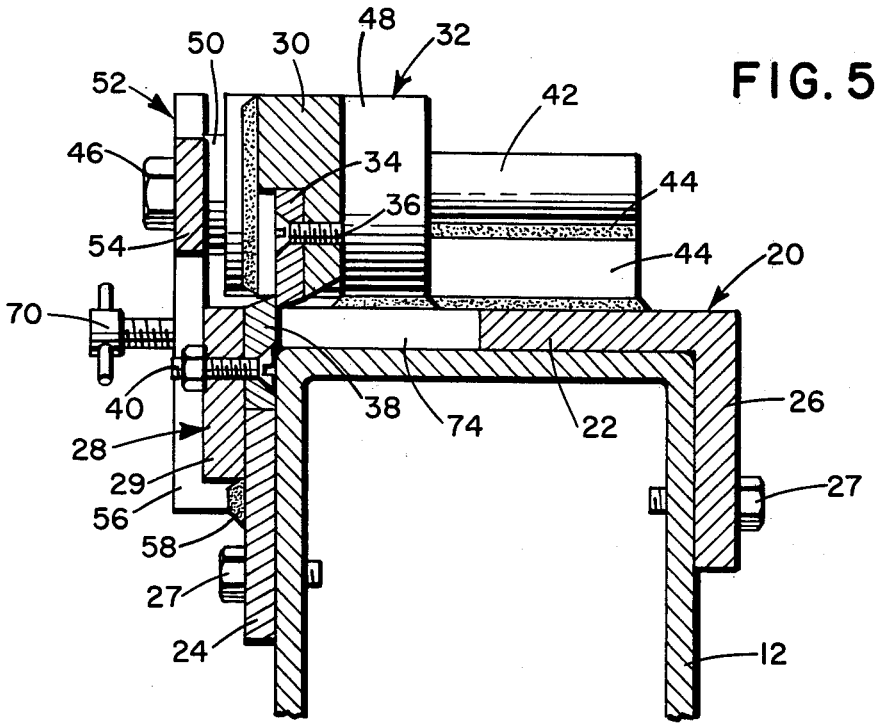
FIG. 5 is a sectional view taken along line 5—5 of FIG. 3.

Shear 10 comprises a generally U-shaped support member 20 having a central portion 22 with side plates 24 and 26 extending outwardly thereof at approximately right angles. Support member 20 is adapted to be disposed about, and mounted to, the top portion of backhoe boom 12. As best shown by FIGS. 4 and 5, this is accomplished by means of conventional bolted fasteners 27 which extend through openings in plates 24 and 26 to engage threaded openings in boom 12. Support member 20 also includes an anvil section 28 comprised of plate 29 attached to central portion 22. Plate 29 partially overlies and is rigidly affixed to side plate 24.

A pivotally mounted cutter head 30 is attached to central portion 22 by means of bearing section 32. Cutter head 30 includes a replaceable blade element 34 which is attached to cutter head 30 by means of threaded fasteners 36. It is anticipated that cutter head 30, as well as most of the other components of the shear, may be fabricated of relatively inexpensive materials while it is anticipated that blade element 34 will be fabricated of an extremely hard, long-lasting material. The expense of shear 10 thus is minimized because the relatively more expensive blade element 34 may be replaced when worn without requiring the replacement of the entire cutter head. Similarly, anvil section 28 includes a replaceable blade element 38 rigidly affixed to an inner face of plate 29 by means of bolted fasteners 40. Blade element 38 most desirably will be fabricated of the same material as blade element 34.

Bearing section 32 comprises a cylinder 42 rigidly affixed to central portion 22 as by welds indicated at 44. Cylinder 42 is drilled and tapped to receive and retain a headed shaft 46. Shaft 46 carries and passes through a spacer 48 rigidly affixed to cylinder 42, cutter head 30, spacer 50, and stripping member 52. These elements are arranged so that cutter head 30 is clamped between spacers 48 and 50. Shaft 46, however, is mounted so that cutter head 30 is free to pivot about shaft 46 without excessive tightness or without excessive looseness. Thus the headed shaft 46 has the head formed by a cap screw which threads into the end of the shaft body to clamp stripping member 52 between the cap screw head and the shaft body. If desired, cutter head 30 may be provided with an opening (not shown) extending through cutter head 30 to shaft 46 for lubrication of cutter head 30's pivotal movement relative to shaft 46.

Figure 2:
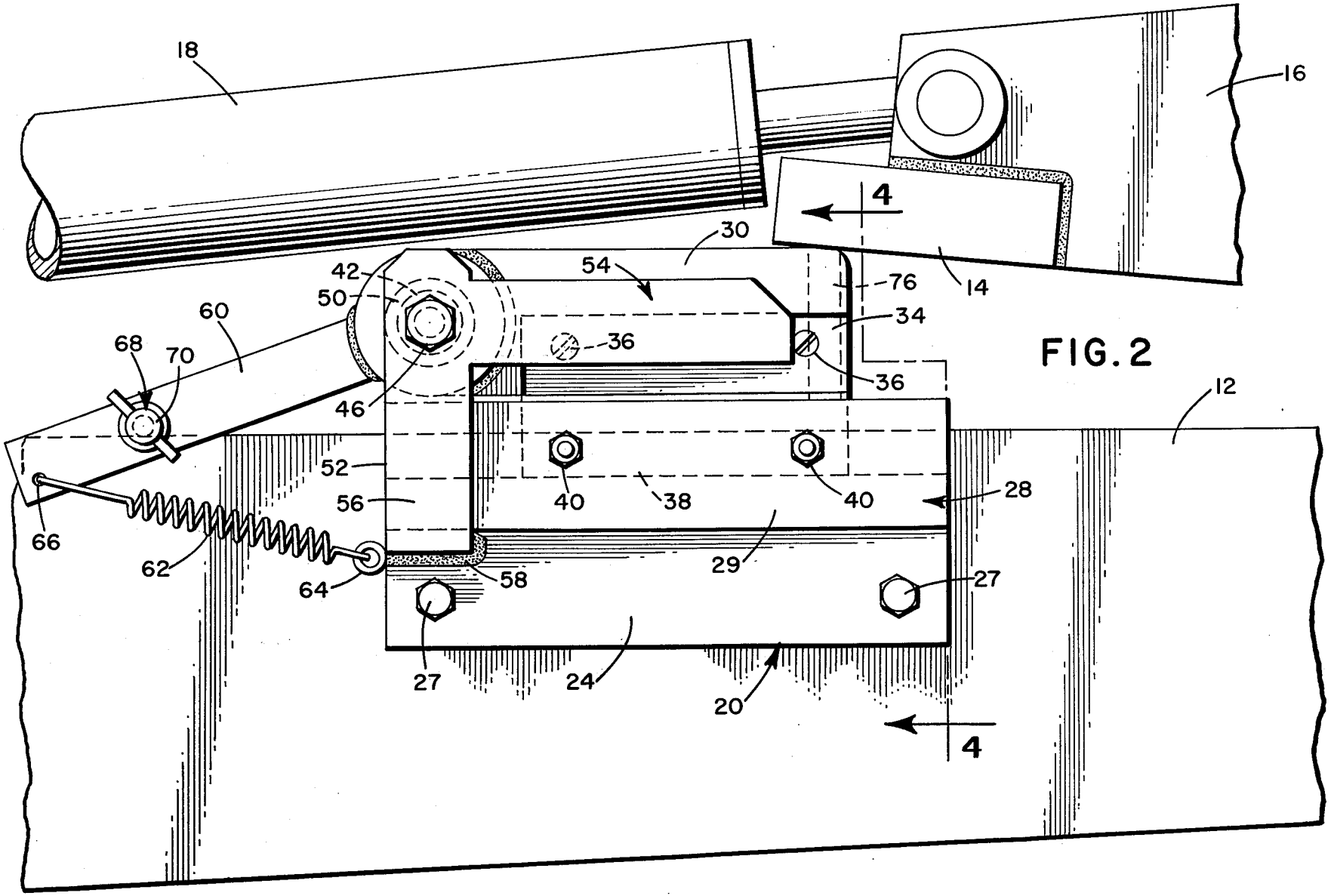
FIG. 2 is a view similar to FIG. 1 showing an enlargement of the backhoe boom mounted shear of FIG. 1.

By the present construction, it is seen that bearing section 32 firmly engages central portion 22 to prevent flexing of the bearing section during a shearing operation. The support for bearing section 32 is assisted by stripping member 52. As best illustrated in FIG. 2, stripping member 52 is an L-shaped member comprised of stripper bar 54 disposed proximate anvil section 28 and spaced slightly therefrom in a generally parallel relationship to blade element 38. The other leg of stripping member 52 comprises a generally vertically disposed support arm 56 which is rigidly affixed at one end to plate 24 as by welds indicated at 58. By this rigid engagement with plate 24, shaft 46 and, hence, bearing section 32 are assisted in bein maintained rigidly during a shearing operation.

Cutter head 30 also includes a return arm 60 extending generally rearwardly thereof. A spring 62 is rigidly affixed to support member 20 at one end by means of eyelet 64 and is affixed to return arm 60 at the other end by means of opening 66. Return arm 60 and spring 62 combine to form a biasing means to constantly urge cutter head 30 to a raised position by pivoting around shaft 46.

A locking means 68 also is provided to hold cutter head 30 in a lowered position relative to anvil action 28 against the force exerted on cutter head 30 by spring 62 through return arm 60. Locking means 68 comprises a threaded fastener 70 which passes through a threaded opening 72 in return arm 60 so as to be selectively engageable with the top portion of backhoe boom 12. When fastener 70 is extended, cutter head 30 will be maintained in that position shown in FIG. 2. This is desirable for safety reasons when shear 10 is not being used for a shearing operation. Also, in using the backhoe for its intended purpose, cutter head 30 might unnecessarily interfere with the operation of dipstick 16 if it were not held in its shear closed position during such backhoe use.

Figure 3:
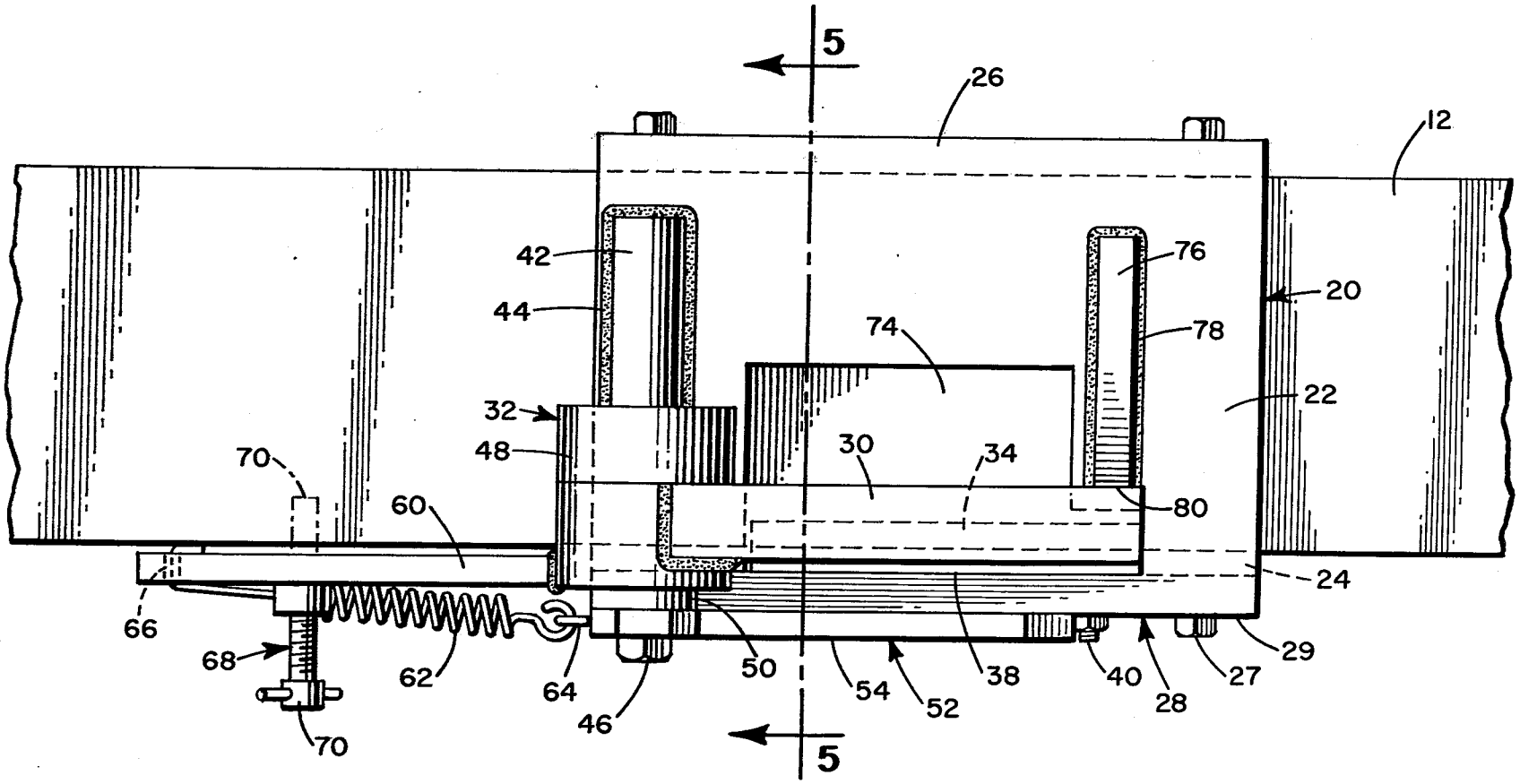
FIG. 3 is a plan view showing a shear according to the invention and similar in scale to FIG. 2.

Referring to FIGS. 3 and 5, it is seen that top plate 22 of support member 20 includes an opening 74. Opening 74 is adjacent blade elements 34 and 38, and extends generally the length of cutter head 30. Opening 74 is provided so that items being sheared may be displaced downwardly into opening 74 and thus lessen resistance to the movement of cutter head 30. If desired, opening 74 may be dispensed with and top plate 22 may be solid. In this case, blade element 38 will be disposed upwardly a distance sufficient to insure full shearing movement of cutter head 30 during a shearing operation.

Referring to FIGS. 3 and 4, a stationary guide member 76 is affixed to top plate 22 by welds as indicated at 78. Vertically extending face 80 of guide member 76 is slideably engaged by a portion of cutter head 30 proximate the end thereof to prevent excessive deflection of cutter head 30 during a shearing operation. Guide member 76 is placed so that little resistance to the movement of cutter head 30 is occasioned while the above-mentioned object is carried out.

OPERATION

It is anticipated that shear 10 will be fabricated as a unit and fitted to existing machinery, such as a backhoe. In this case, support member 20 is fitted about boom 12 and boom 12 is drilled and tapped to accept threaded fasteners 27. Extension 14 next is rigidly affixed, as by welding, to the rear end of dipstick 16. Of course, extension 14 is placed so that a proper engagement with cutter head 30 occurs when the dipstick 16 and boom 12 are moved relative to each other under the power of hydraulic cylinder 18. After extension 14 and shear 10 are in place the apparatus is ready for use.

Hydraulic cylinder 18 then may be actuated to swing dipstick 16 and extension 14 away from shear 10, permitting cutter head 30 to pivot to a raised position relative to anvil section 28. Thereafter, items to be sheared may be inserted between stripper bar 54 and blade element 38 on the anvil section 28. Upon actuation of hydraulic cylinder 18, extension 14 carried by dipstick 16 is depressed against cutter head 30 with the further result that cutter head 30 is pivotally lowered against the bias of spring 62. Any items placed between stripper bar 54 and blade element 38 are thereupon sheared. During the shearing operation, stripper bar 54 prevents excessive deflection of items being sheared and, after the shearing operation is completed, stripper bar 54 assists cutter head 30 in separating the sheared ends from cutter head 30. When shear 10 no longer is needed for shear operations, cutter head 30 may be depressed to that position shown in FIG. 2 and locking means 68 actuated to maintain cutter head 30 in its lowered position relative to anvil section 28.

It will be observed that the shear of the present invention may be fitted readily to existing machinery inexpensively and with little effort. Because it is carried wherever the machinery goes, the disadvantages of prior art independent and stationary shears are obviated. It also will be appreciated that the elements of the shear may be sized appropriately to shear virtually any type of material. Accordingly, while a specific embodiment of the invention has been described, it will be obvious to those skilled in the art that changes and modifications may be made without departing from the invention. It is therefore intended in the appended claims to cover all such changes and modifications that fall within the true spirit and scope of the invention.

I claim:

1. A shearing apparatus, comprising, in combination:

a. a shear having a cutting head; and b. a backhoe having a backhoe dipstick on a backhoe boom, said shear being mounted on one of said boom and dipstick and said cutter head being actuated by the other of said boom and dipstick.

2. The apparatus of claim 1, wherein:

a. said cutter head is pivotally mounted to said shear; and b. said shear additionally includes an anvil section, said anvil section being rigidly affixed to a portion of said shear and adapted to be engaged by said cutter head to carry out a shearing operation.

3. The apparatus of claim 2, wherein said shear additionally includes a biasing means for said cutter head, said biasing means acting to urge said cutter head to a raised position relative to said anvil section.

4. The apparatus of claim 3, wherein said shear additionally includes a locking means for said cutter head, said locking means acting to hold said cutter head in a lowered position relative to said anvil section against the force exerted on said cutter head by said biasing means.

5. The apparatus of claim 4, wherein:

a. said biasing means comprises a spring affixed at one end to a stationary portion of said apparatus and affixed at the other end to a portion of said cutter head; and b. said locking means comprises a fastener affixed to a portion of said cutter head and engagement with a stationary portion of said apparatus.

6. The apparatus of claim 2, wherein a guide member is included as part of said shear, said guide member slideably engaging a portion of said cutter head and serving to prevent excessive deflection of said cutter head during a shearing operation.

7. The apparatus of claim 2, wherein:

a. said cutter head includes a replaceable blade element; and b. said anvil section includes a replaceable blade element.

8. The apparatus of claim 2 wherein said shear additionally includes a stripping member disposed proximate said anvil section and spaced therefrom in a generally parallel relationship.

* * * * *